US011050194B2

(12) United States Patent
Oosaka et al.

(10) Patent No.: US 11,050,194 B2
(45) Date of Patent: Jun. 29, 2021

(54) CONNECTOR

(71) Applicant: Japan Aviation Electronics Industry, Limited, Tokyo (JP)

(72) Inventors: Junji Oosaka, Tokyo (JP); Hiroaki Kuribayashi, Tokyo (JP); Masamichi Sasaki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/838,361

(22) Filed: Apr. 2, 2020

(65) Prior Publication Data

US 2020/0381871 A1 Dec. 3, 2020

(30) Foreign Application Priority Data

May 31, 2019 (JP) ..... JP2019-102600

(51) Int. Cl.
*H01R 33/00* (2006.01)
*H01R 13/6585* (2011.01)
*H01R 13/405* (2006.01)

(52) U.S. Cl.
CPC ..... *H01R 13/6585* (2013.01); *H01R 13/405* (2013.01)

(58) Field of Classification Search
CPC .. H01R 12/722; H01R 12/724; H01R 13/405; H01R 13/6581; H01R 13/6585
USPC ..... 439/607.05, 660
See application file for complete search history.

(56) References Cited

U.S. PATENT DOCUMENTS

| | | | | |
|---|---|---|---|---|
| 9,634,409 | B2 * | 4/2017 | Tsai | H01R 13/6581 |
| 9,685,740 | B1 * | 6/2017 | Hsu | H05K 7/1401 |
| 9,742,098 | B2 * | 8/2017 | Zhao | H01R 13/6581 |
| 10,050,365 | B1 * | 8/2018 | Ju | H01R 13/648 |
| 10,355,421 | B2 * | 7/2019 | Zhao | H01R 13/6594 |

FOREIGN PATENT DOCUMENTS

TW I630763 B 7/2018

* cited by examiner

*Primary Examiner* — Khiem M Nguyen
(74) *Attorney, Agent, or Firm* — Muncy, Geissler, Olds & Lowe, P.C.

(57) ABSTRACT

A connector includes contacts, a mid-plate and a housing, each contact having a contact portion at a front end portion and having a length corresponding to an effective connection length along a fitting direction, an exposed portion adjacent to a rear end of the contact portion and exposed from the housing, a connecting portion at a rear end portion, and a holding portion between the exposed portion and the connecting portion and at least partially embedded in the housing, the contact portion of each contact being disposed away from the mid-plate by a predetermined distance, each of a plurality of pairs of contacts having a separation portion separated from the mid-plate by a separation distance longer than the predetermined distance, the separation portion including the exposed portion and a part of the holding portion adjacent to a rear end of the exposed portion in the fitting direction.

8 Claims, 5 Drawing Sheets

CONNECTOR

BACKGROUND OF THE INVENTION

The present invention relates to a connector, particularly to a connector having a plurality of contacts and a conductive mid-plate.

A connector having a plurality of contacts and a conductive mid-plate facing the plurality of contacts has been conventionally known. For instance, as shown in FIG. 12, TW I630763B discloses a connector in which a plurality of contacts 2 face one surface of a mid-plate 1 of flat plate shape made of metal and a plurality of contacts 3 face the other surface of the mid-plate 1.

As shown in FIG. 13, each of the contacts 2 has a contact portion 2A that is disposed at a front end portion in a fitting direction and makes contact with a contact of a counter connector (not shown), a connecting portion 2B that is disposed at a rear end portion in the fitting direction and is connected to a substrate or the like (not shown), and a holding portion 2C that is disposed between the contact portion 2A and the connecting portion 2B. As with the contacts 2, each of the contacts 3 also has a contact portion 3A, a connecting portion 3B and a holding portion 3C.

As shown in FIG. 14, the mid-plate 1, the contacts 2 and the contacts 3 are integrally formed with a housing 4 to thereby form the connector. The contact portions 2A of the plurality of contacts 2 and the contact portions 3A of the plurality of contacts 3 are disposed to be exposed from the housing 4, and the connecting portions 2B of the plurality of contacts 2 and the connecting portions 3B of the plurality of contacts 3 project behind the housing 4.

While the mid-plate 1 is provided to electrically isolate the plurality of contacts 2 and the plurality of contacts 3 from each other, in the connector having the mid-plate 1, the plurality of contacts 2 and the plurality of contacts 3 as above, the plurality of contacts 2 and the plurality of contacts 3 are disposed close to the mid-plate 1, whereby crosstalk may occur among the plurality of contacts 2 or among the plurality of contacts 3 via the mid-plate 1, so that transmission characteristics may be deteriorated.

To cope with it, as shown in FIG. 13, deformed portions 2D and 3D that are deformed to be away from the mid-plate 1 are formed at part of the holding portion 2C of the contact 2 and part of the holding portion 3C of the contact 3, respectively. The presence of the deformed portions 2D and 3D allows the occurrence of crosstalk via the mid-plate 1 to be suppressed.

However, as presumed from FIG. 14, while the contact portions 2A and 3A of the contacts 2 and 3 are exposed from the housing 4, the deformed portions 2D and 3D are embedded in the housing 4. That is, since the provision of the deformed portions 2D and 3D of the contacts 2 and 3 that are deformed to be away from the mid-plate 1 is limited to a portion embedded in the housing 4, the deformed portions 2D and 3D that extend long along the fitting direction cannot be ensured, and thus it is difficult to sufficiently suppress the occurrence of crosstalk.

SUMMARY OF THE INVENTIION

The present invention has been made in order to solve the conventional problem described above and is aimed at providing a connector capable of sufficiently suppressing the occurrence of crosstalk even when the connector is provided with a plurality of contacts and a conductive mid-plate.

A connector according to the present invention is a connector having a predetermined effective connection length and comprises:

a plurality of contacts having conductivity, the plurality of contacts extending in a fitting direction for fitting with a counter connector and being arranged in an arrangement direction perpendicular to the fitting direction;

a mid-plate of flat plate shape and having conductivity, the mid-plate extending in the fitting direction and the arrangement direction and being disposed to face the plurality of contacts; and a housing having insulating properties, the housing holding the plurality of contacts and the mid-plate, wherein the plurality of contacts comprise a first contact row and a second contact row that are separately arranged to face both surfaces of the mid-plate, wherein each of the first contact row and the second contact row includes a plurality of pairs of contacts, wherein each of the plurality of contacts has a contact portion that is disposed at a front end portion in the fitting direction, has a length corresponding to the effective connection length along the fitting direction, is exposed from the housing and makes contact with a contact of the counter connector, an exposed portion that is disposed adjacent to a rear end of the contact portion in the fitting direction and is exposed from the housing, a connecting portion that is disposed at a rear end portion in the fitting direction and is connected to a connection target, and a holding portion that is disposed between the exposed portion and the connecting portion and is at least partially embedded in the housing, wherein the contact portion of each of the plurality of contacts is disposed away from the mid-plate by a predetermined distance in a direction perpendicular to the mid-plate, wherein each of at least the plurality of pairs of contacts of the plurality of contacts has a separation portion that are separated from the mid-plate in the direction perpendicular to the mid-plate by a separation distance longer than the predetermined distance, and wherein the separation portion includes the exposed portion and a part of the holding portion adjacent to a rear end of the exposed portion in the fitting direction.

DETAILED DESCRIPTION OF THE INVENTION

An embodiment of the present invention is described below based on the appended drawings.

Figure 1:
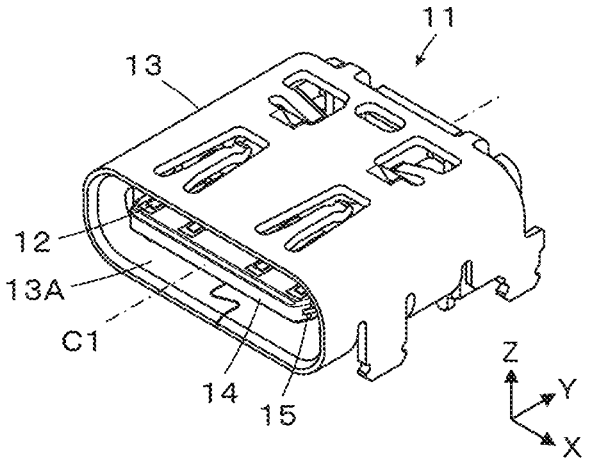
FIG. 1 is a perspective view showing a connector according to an embodiment of the present invention.

FIG. 1 shows a connector 11 according to an embodiment. The connector 11 is a receptacle connector to be mounted on a circuit board or the like in an electronic device and has a plurality of conductive contacts 12 that extend in a fitting direction along a fitting axis C1 and are arranged in a direction perpendicular to the fitting axis C1.

A conductive peripheral shell 13 extending along the fitting axis C1 is disposed to cover the periphery of the front end portions, in the fitting direction, of the plurality of contacts 12, and a counter connector accommodating portion 13A that opens frontward in the fitting direction and into which a counter connector (not shown) is to be inserted is formed inside the peripheral shell 13. An insulating housing 14 is disposed inside the counter connector accommodating portion 13A and holds the plurality of contacts 12. The peripheral shell 13 surrounds an outer periphery of the housing 14.

A conductive mid-plate 15 of flat plate shape is embedded and held in the housing 14.

Figure 2:
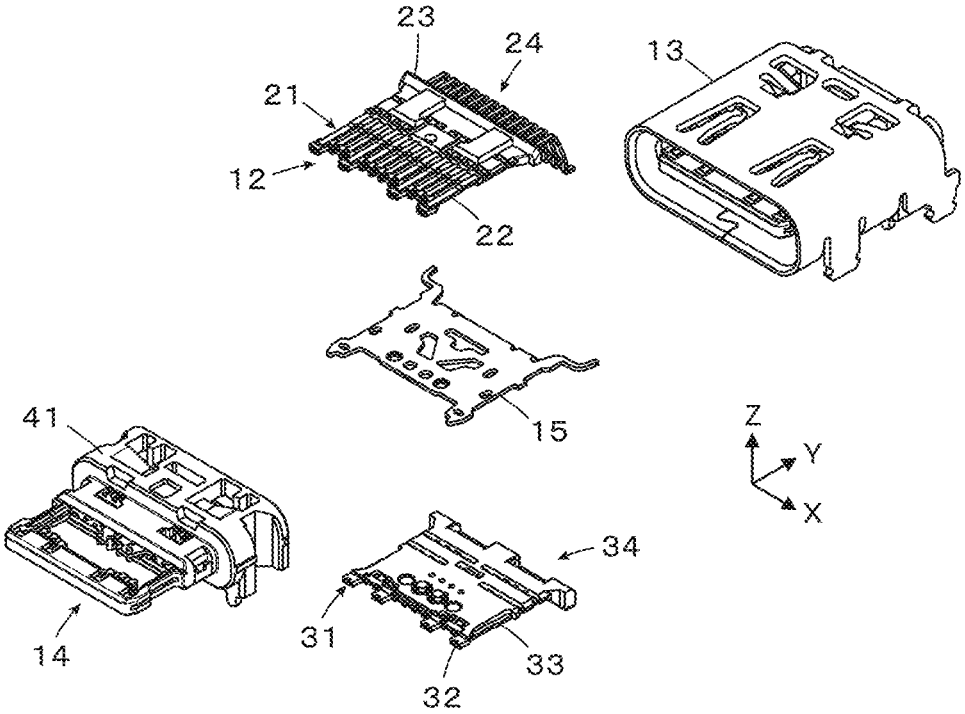
FIG. 2 is an exploded perspective view of the connector according to the embodiment.

FIG. 2 shows an exploded view of the connector 11. The plurality of contacts 12 has a first contact row 21 arranged to face one surface of the mid-plate 15 and a second contact row 31 arranged to face the other surface of the mid-plate 15. The first contact row 21 is constituted of a plurality of first contacts 22 that form a first module 24 modularized with an insulator 23. Similarly, the second contact row 31 is constituted of a plurality of second contacts 32 that form a second module 34 modularized with an insulator 33.

The connector 11 has an insulator 41 that integrally forms the mid-plate 15, the first module 24 and the second module 34, and the insulators 23, 33 and 41 constitute the housing 14.

For convenience, the direction from front to back of the connector 11 along the fitting axis C is called "+Y direction," the arrangement direction of the first contact row 21 and the second contact row 31 "X direction," and the direction perpendicular to an XY plane and extending from the second module 34 to the first module 24 "+Z direction."

Figure 3:
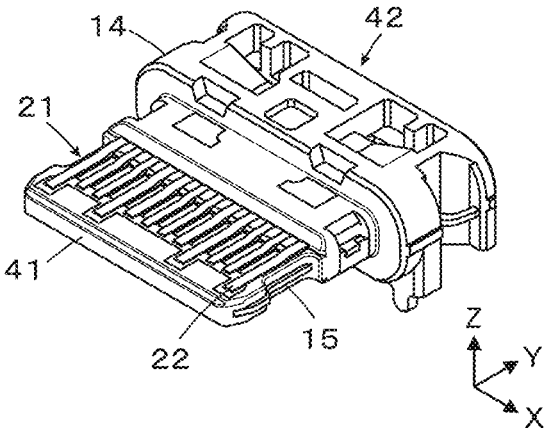
FIG. 3 is a perspective view showing a contact assembly in the connector according to the embodiment.

As a result of the formation of the insulator 41, as shown in FIG. 3, a contact assembly 42 in which the plurality of first contacts 22 of the first contact row 21, the plurality of second contacts 32 of the second contact row 31 and the mid-plate 15 are integrally formed with the housing 14 is formed. In FIG. 3, the plurality of second contacts 32 of the second contact row 31 are not shown because they are hidden on the −Z direction side of the insulator 41.

The connector 11 shown in FIG. 1 is produced by attaching the peripheral shell 13 to the contact assembly 42.

Figure 4:
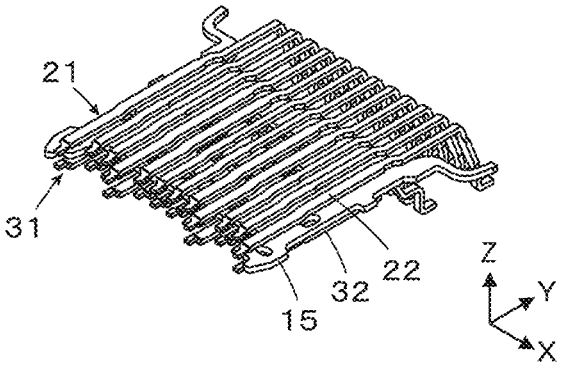
FIG. 4 is a perspective view showing a mid-plate and a plurality of contacts used in the connector according to the embodiment.

FIG. 4 shows the first contact row 21 disposed on the +Z direction side of the mid-plate 15 and the second contact row 31 disposed on the −Z direction side of the mid-plate 15 as sandwiching the mid-plate 15 therebetween. The plurality of first contacts 22 constituting the first contact row 21 are arranged in the X direction and are each formed from a metal member of plate shape extending substantially in the Y direction. Similarly, the plurality of second contacts 32 constituting the second contact row 31 are arranged in the X direction and are each formed from a metal member of plate shape extending substantially in the Y direction.

The mid-plate 15 is provided to electrically isolate the first contact row 21 and the second contact row 31 from each other and is formed from, for instance, a metal plate.

Figure 5:
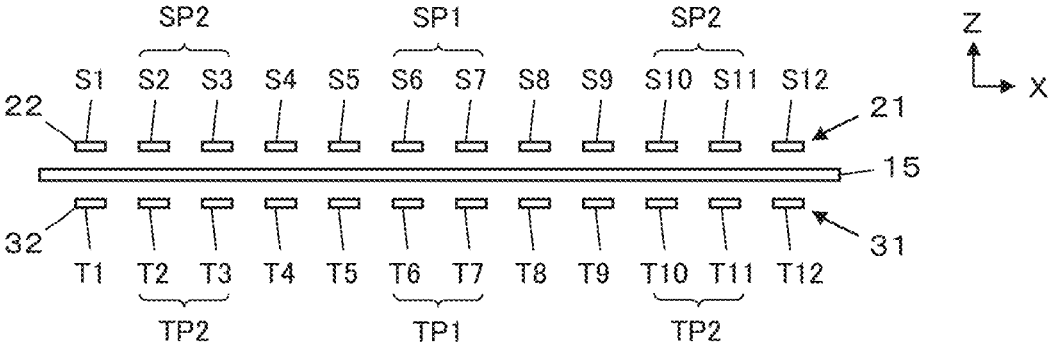
FIG. 5 is a diagram schematically showing the mid-plate and the plurality of contacts used in the connector according to the embodiment.

As shown in FIG. 5, the plurality of first contacts 22 constituting the first contact row 21 have twelve contacts S1 to S12 arranged from the −X direction to the +X direction. Of these contacts, two contacts S6 and S7 located at a middle part in the X direction constitute a first pair SP1 of contacts for low-speed signal transmission, contacts S1 and S12 separately located on the outermost sides in the X direction are grounding contacts, and two contacts S2 and S3 adjacent to the contact S1 and two contacts S11 and S10 adjacent to the contact S12 separately constitute second pairs SP2 of contacts for high-speed signal transmission. Remaining contacts S4, S5, S8 and S9 are contacts for a power supply or contacts for use in, for instance, detection of insertion and removal of the connector 11.

Similarly, the plurality of second contacts 32 constituting the second contact row 31 have twelve contacts T1 to T12 arranged from the −X direction to the +X direction. Of these contacts, two contacts T6 and T7 located at a middle part in the X direction constitute a first pair TP1 of contacts for low-speed signal transmission, contacts T1 and T12 separately located on the outermost sides in the X direction are grounding contacts, and two contacts T2 and T3 adjacent to the contact T1 and two contacts T11 and T10 adjacent to the contact T12 separately constitute second pairs TP2 of contacts for high-speed signal transmission. Remaining contacts T4, T5, T8 and T9 are contacts for a power supply or contacts for use in, for instance, detection of insertion and removal of the connector 11.

As above, each of the first contact row 21 and the second contact row 31 includes three pairs of contacts used for transmitting electric signals.

Figure 6:
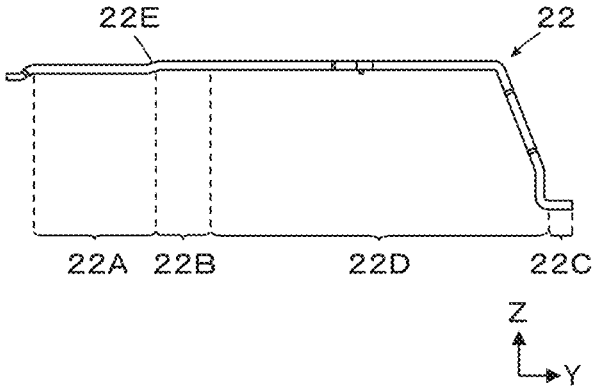
FIG. 6 is a side view showing a first contact used in the connector according to the embodiment.

As shown in FIG. 6, a contact portion 22A that is exposed from the housing 14 and makes contact with a contact of a counter connector (not shown) is formed at a −Y directional end of the first contact 22, and an exposed portion 22B having a predetermined length is formed on a rear end side in the fitting direction with respect to the contact portion 22A, that is, adjacent to the +Y direction side of the contact portion 22A. The exposed portion 22B is a portion that is exposed from the housing 14 but does not make contact with the contact of the counter connector.

A connecting portion 22C to be connected to a connection target such as a circuit board on which the connector 11 is mounted is disposed at a+Y directional end of the first contact 22, and a holding portion 22D that is held in the housing 14 by being at least partially embedded in the housing 14 is disposed between the exposed portion 22B and the connecting portion 22C.

The contact portion 22A extends along the Y direction and has a length corresponding to an effective connection length of the connector 11. The expression "an effective connection length of the connector 11" means a distance that a contact of a counter connector (not shown) moves in contact with a surface of the first contact 22 or the second contact 32 of the connector 11 when the counter connector is fitted with the connector 11. The exposed portion 22B also extends along the Y direction as with the contact portion 22A but is located at a position deviated in the +Z direction from the contact portion 22A, and a contact step portion 22E is formed at a boundary portion between the contact portion 22A and the exposed portion 22B.

A −Y directional portion of the holding portion 22D connected to the exposed portion 22B extends along the Y direction in the same position in the Z direction as the exposed portion 22B, and a step is not present at a boundary portion between the exposed portion 22B and the holding portion 22D. Therefore, the boundary portion between the exposed portion 22B and the holding portion 22D cannot be discerned from the first contact 22, and when the contact assembly 42 is formed as shown in FIG. 3, a portion that is not embedded in and is exposed from the housing 14 serves as the exposed portion 22B, and the +Y direction side from a portion that is embedded in the housing 14 serves as the holding portion 22D.

Figure 7:
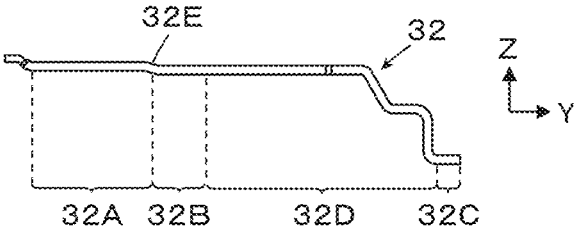
FIG. 7 is a side view showing a second contact used in the connector according to the embodiment.

As shown in FIG. 7, a contact portion 32A that is exposed from the housing 14 and makes contact with a contact of a counter connector (not shown) is formed at a −Y directional end of the second contact 32, and an exposed portion 32B having a predetermined length is formed on a rear end side in the fitting direction with respect to the contact portion 32A, that is, adjacent to the +Y direction side of the contact portion 32A. The exposed portion 32B is a portion that is exposed from the housing 14 but does not make contact with the contact of the counter connector.

A connecting portion 32C to be connected to a connection target such as a circuit board on which the connector 11 is mounted is disposed at a+Y directional end of the second contact 32, and a holding portion 32D that is held in the housing 14 by being at least partially embedded in the housing is disposed between the exposed portion 32B and the connecting portion 32C.

The contact portion 32A extends along the Y direction and has a length corresponding to the effective connection length of the connector 11. The exposed portion 32B also extends along the Y direction as with the contact portion 32A but is located at a position deviated in the −Z direction from the contact portion 32A, and a contact step portion 32E is formed at a boundary portion between the contact portion 32A and the exposed portion 32B.

A −Y directional portion of the holding portion 32D connected to the exposed portion 32B extends along the Y direction in the same position in the Z direction as the exposed portion 32B, and a step is not present at a boundary portion between the exposed portion 32B and the holding portion 32D. Therefore, the boundary portion between the exposed portion 32B and the holding portion 32D cannot be discerned from the second contact 32, and when the contact assembly 42 is formed as shown in FIG. 3, a portion that is not embedded in and is exposed from the housing 14 serves as the exposed portion 32B, and the +Y direction side from a portion that is embedded in the housing 14 serves as the holding portion 32D.

The contact portion 32A and the exposed portion 32B of the second contact 32 respectively have the same Y directional lengths as those of the contact portion 22A and the exposed portion 22B of the first contact 22. On the other hand, the holding portion 32D of the second contact 32 has a shorter Y directional length than that of the holding portion 22D of the first contact 22.

Figure 8:
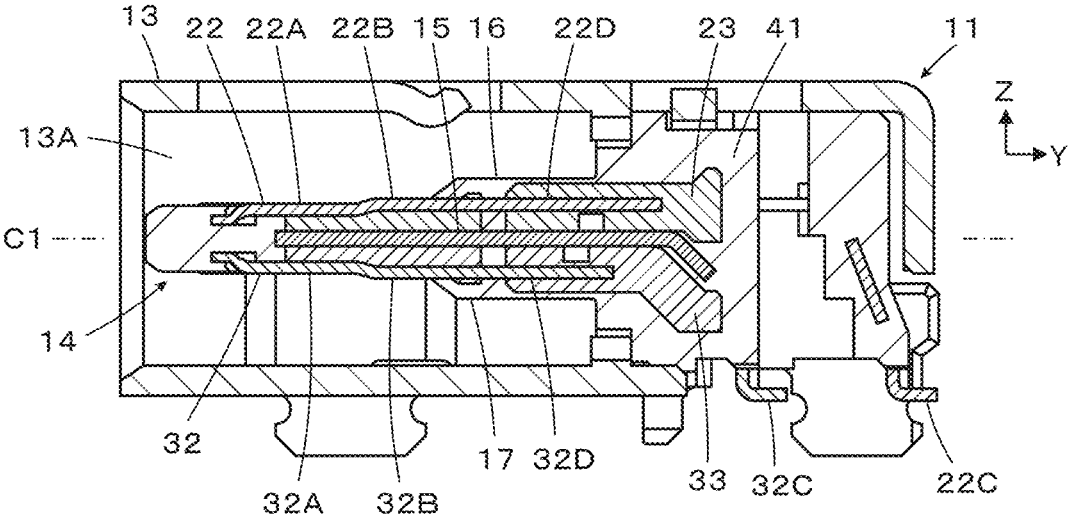
FIG. 8 is a cross-sectional side view of the connector according to the embodiment.

FIG. 8 shows a cross-sectional side view of the connector cut along a YZ plane. The contact portion 22A, the exposed portion 22B and the −Y directional portion of the holding portion 22D of the first contact 22 and the contact portion 32A, the exposed portion 32B and the −Y directional portion of the holding portion 32D of the second contact 32 are surrounded by the peripheral shell 13 and disposed in the counter connector accommodating portion 13A, the contact portion 22A, the exposed portion 22B and the −Y directional portion of the holding portion 22D of the first contact 22 face the +Z directional surface of the mid-plate 15, and the contact portion 32A, the exposed portion 32B and the −Y directional portion of the holding portion 32D of the second contact 32 face the −Z directional surface of the mid-plate 15.

The contact portion 22A and the exposed portion 22B of the first contact 22 are exposed in the +Z direction from the housing 14 in the counter connector accommodating portion 13A without being embedded in the housing 14. Similarly, the contact portion 32A and the exposed portion 32B of the second contact 32 are exposed in the −Z direction from the housing 14 in the counter connector accommodating portion 13A without being embedded in the housing 14.

On the other hand, the −Y directional portion of the holding portion 22D adjacent to the exposed portion 22B of the first contact 22 is embedded in the housing 14, and the housing has a housing step portion 16 covering the −Y directional portion of the holding portion 22D from the +Z direction. Similarly, the −Y directional portion of the holding portion 32D adjacent to the exposed portion 32B of the second contact 32 is embedded in the housing 14, and the housing 14 has a housing step portion 17 covering the −Y directional portion of the holding portion 32D from the −Z direction.

The connecting portion 22C of the first contact 22 and the connecting portion 32C of the second contact 32 protrude in the −Z direction from the housing 14 at the +Y directional end of the connector 11. Since the holding portion 32D of the second contact 32 has a shorter Y directional length than that of the holding portion 22D of the first contact 22, the connecting portion 32C of the second contact 32 is located on the −Y directional side of the connecting portion 22C of the first contact 22. Thus, since the connecting portions 22C of the plurality of first contacts 22 arranged in the X direction and the connecting portions 32C of the plurality of second contacts arranged in the X direction are disposed at positions different from each other in the Y direction, respective installation spaces for the contact portions 22C and 32C are ensured, which facilitates connection to a connection target such as a circuit board.

Figure 9:
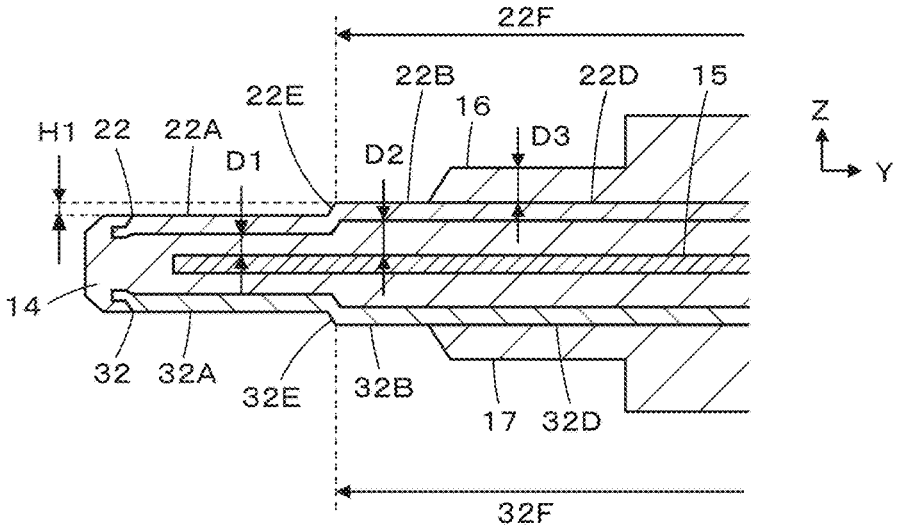
FIG. 9 is a partial cross-sectional view schematically showing the mid-plate, the first contact and the second contact that are held by a housing in the connector according to the embodiment.

Here, as shown in FIG. 9, the exposed portion 22B of the first contact 22 is located at the position deviated in the +Z direction from the contact portion 22A, the contact portion 22A is disposed away from the mid-plate 15 by a predetermined distance D1 in the +Z direction perpendicular to the mid-plate 15, and the exposed portion 22B is disposed away from the mid-plate 15 by a separation distance D2 longer than the predetermined distance D1 in the +Z direction. When the height of the contact step portion 22E formed at the boundary portion between the contact portion 22A and the exposed portion 22B is H1, D2=D1+H1 is satisfied.

Further, since the −Y directional portion of the holding portion 22D adjacent to the exposed portion 22B also extends along the Y direction in the same position in the Z direction as the exposed portion 22B, a separation portion 22F separated from the mid-plate 15 by the separation distance D2 longer than the predetermined distance D1 is formed to extend from the exposed portion 22B to the −Y directional portion of the holding portion 22D.

Similarly, the exposed portion 32B of the second contact 32 is located at the position deviated in the −Z direction from the contact portion 32A, the contact portion 32A is disposed away from the mid-plate 15 by the predetermined distance D1 in the −Z direction perpendicular to the mid-plate 15, and the exposed portion 32B is disposed away from the mid-plate 15 by the separation distance D2 longer than the predetermined distance D1 in the −Z direction. When the height of the contact step portion 32E formed at the boundary portion between the contact portion 32A and the exposed portion 32B is H1, D2=D1+H1 is satisfied.

Further, since the −Y directional portion of the holding portion 32D adjacent to the exposed portion 32B also extends along the Y direction in the same position in the Z direction as the exposed portion 32B, a separation portion 32F separated from the mid-plate 15 by the separation distance D2 longer than the predetermined distance D1 is formed to extend from the exposed portion 32B to the −Y directional portion of the holding portion 32D.

As above, in the connector 11, the separation portion 22F of the first contact 22 that is separated from the mid-plate 15 in the +Z direction by the separation distance D2 extends not only to the holding portion 22D embedded in the housing 14 but also to the exposed portion 22B exposed from the housing 14. Similarly, the separation portion 32F of the second contact 32 that is separated from the mid-plate 15 in the −Z direction by the separation distance D2 extends not only to the holding portion 32D embedded in the housing 14 but also to the exposed portion 32B exposed from the housing 14.

Each of the plurality of first contacts 22 has the separation portion 22F, each of the plurality of second contacts has the separation portion 32F, and all of the separation portions 22F and 32F are separated from the mid-plate 15 by the same separation distance D2.

Therefore, the long separation portions 22F and 32F along the Y direction are ensured in the first contact 22 and the second contact 32, respectively, and it is possible to sufficiently suppress the occurrence of crosstalk via the mid-plate 15 while the plurality of first contacts 22 and the plurality of second contacts 32 are electrically isolated from each other via the mid-plate 15. Thus, electric signals can be transmitted with excellent characteristics.

The housing step portion 16 covering the −Y directional portion of the holding portion 22D of the first contact 22 from the +Z direction has a thickness D3 equal to the separation distance D2 from the mid-plate 15 in the separation portion 22F. Similarly, the housing step portion 17 covering the −Y directional portion of the holding portion 32D of the second contact 32 from the −Z direction also has the thickness D3 equal to the separation distance D2 from the mid-plate 15 in the separation portion 32F.

Figure 10:
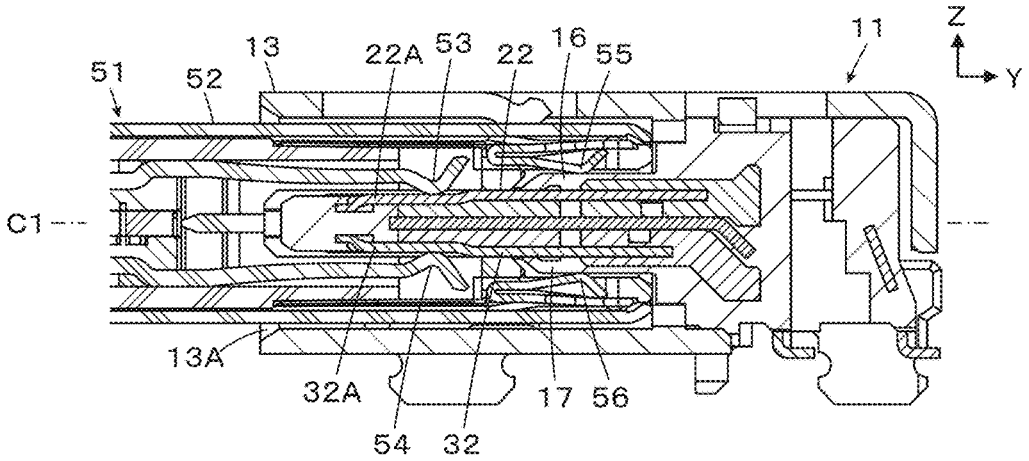
FIG. 10 is a cross-sectional side view showing a state where a counter connector is fitted with the connector according to the embodiment.

FIG. 10 shows the connector 11 in the fitting state with a counter connector 51. The counter connector 51 has a metal shell 52, a plurality of first contacts 53 of plate spring shape arranged in the X direction are disposed on the +Z direction side in the shell 52, and a plurality of second contacts 54 of plate spring shape arranged in the X direction are disposed on the −Z direction side in the shell 52. The plurality of first contacts 53 correspond to the plurality of first contacts 22 of the connector 11, and the plurality of second contacts 54 correspond to the plurality of second contacts 32 of the connector 11.

A pair of metal pressing portions 55 and 56 of plate spring shape electrically connected to the shell 52 are disposed to face each other in the Z direction in the shell 52 on the side close to the +Y directional end of the counter connector 51.

The +Y directional end of the counter connector 51 is inserted in the counter connector accommodating portion 13A of the connector 11 along the fitting axis C1, the pressing portion 55 of the counter connector 51 makes contact with the housing step portion 16 on the +Z direction side of the connector 11 and presses the housing step portion 16 in the −Z direction, and the pressing portion 56 of the counter connector 51 makes contact with the housing step portion 17 on the −Z direction side of the connector 11 and presses the housing step portion 17 in the +Z direction. As a result, the +Y directional end of the counter connector 51 is positioned in the counter connector accommodating portion 13A of the connector 11.

At this time, each of the plurality of first contacts 53 of the counter connector 51 makes contact with the contact portion 22A of the corresponding first contact 22 of the connector 11, and each of the plurality of second contacts 54 of the counter connector 51 makes contact with the contact portion 32A of the corresponding second contact 32 of the connector 11. As a result, the plurality of first contacts 53 and the plurality of second contacts 54 of the counter connector 51 are electrically connected to the plurality of first contacts 22 and the plurality of second contacts 32 of the connector 11, respectively, and in this state, electric signals are transmitted.

Since the metal pressing portion 55 of the counter connector 51 makes contact with the housing step portion 16 on the +Z direction side of the connector 11, the −Y directional portion of the holding portion 22D of the first contact 22 is sandwiched between the conductive mid-plate 15 and the pressing portion 55 of the counter connector 51 in the Z direction; however, since the separation distance D2 from the mid-plate 15 and the thickness D3 of the housing step portion 16 are equal to each other, electric signals can be efficiently transmitted.

Similarly, since the metal pressing portion 56 of the counter connector 51 makes contact with the housing step portion on the −Z direction side of the connector 11, the −Y directional portion of the holding portion 32D of the second contact 32 is sandwiched between the conductive mid-plate 15 and the pressing portion 56 of the counter connector 51 in the Z direction; however, since the separation distance D2 from the mid-plate 15 and the thickness D3 of the housing step portion 17 are equal to each other, electric signals can be efficiently transmitted.

Figure 11:
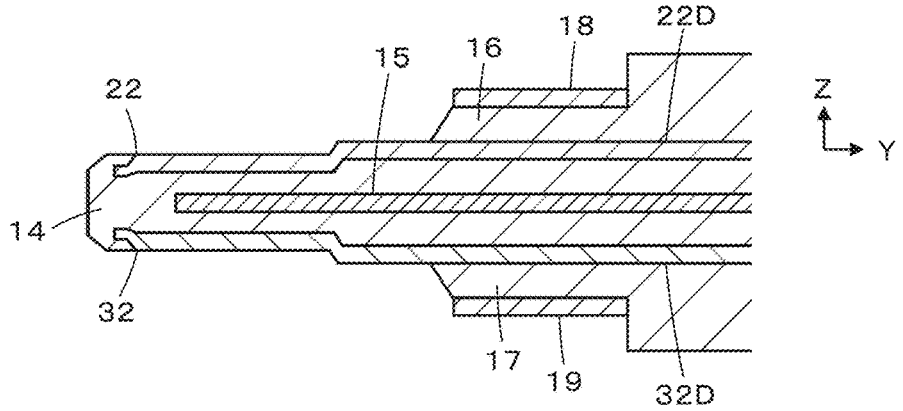
FIG. 11 is a partial cross-sectional view schematically showing a mid-plate, a first contact and a second contact that are held by a housing in a connector according to a modification.
Figure 12:
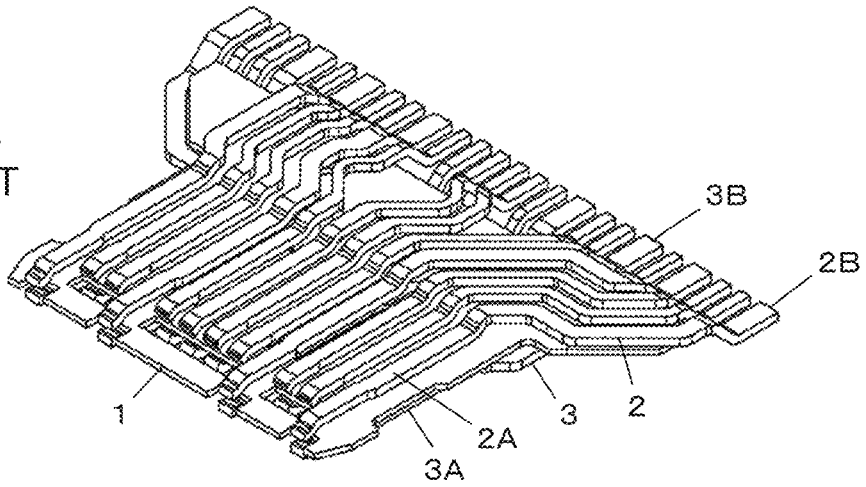
FIG. 12 PRIOR ART
FIG. 12 is a perspective view showing a mid-plate and a plurality of contacts used in a conventional connector.
Figure 13:
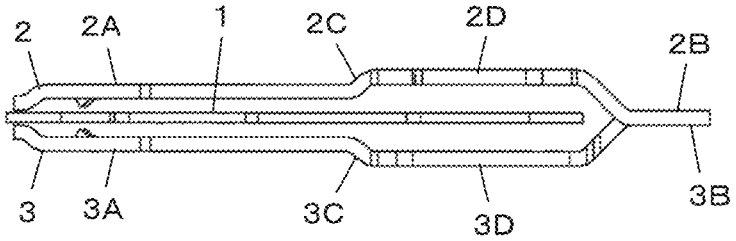
FIG. 13 PRIOR ART
FIG. 13 is a side view showing the mid-plate and the plurality of contacts used in the conventional connector.
Figure 14:
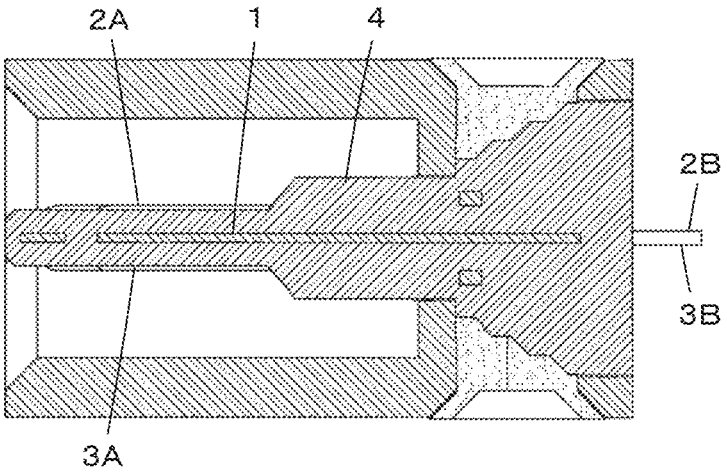
FIG. 14 PRIOR ART
FIG. 14 is a cross-sectional side view showing the conventional connector.

As shown in FIG. 11, conductive ground plates 18 and 19 of flat plate shape may be disposed on the housing step portion 16 on the +Z direction side and the housing step portion 17 on the −Z direction side, respectively. The ground plates 18 and 19 are formed from, for instance, a metal plate and electrically connected to the conductive peripheral shell 13 of the connector 11 shown in FIG. 8 or the like.

With this configuration, as shown in FIG. 10, in the fitting state between the connector 11 and the counter connector 51, when the pressing portions 55 and 56 of the counter connector 51 make contact with the ground plates 18 and 19 of the connector 11, respectively, the peripheral shell 13 of the connector 11 and the shell 52 of the counter connector 51 can be electrically connected to each other.

Thus, when the ground plates 18 and 19 are disposed on the housing step portions 16 and 17, respectively, the −Y directional portion of the holding portion 22D of the first contact 22 is sandwiched between the conductive mid-plate 15 and the ground plate 18 in the Z direction; however, since the separation distance D2 from the mid-plate 15 and the thickness D3 of the housing step portion 16 are equal to each other, electric signals can be efficiently transmitted. Similarly, the −Y directional portion of the holding portion 32D of the second contact 32 is sandwiched between the conductive mid-plate 15 and the ground plate 19 in the Z direction; however, since the separation distance D2 from the mid-plate 15 and the thickness D3 of the housing step portion 17 are equal to each other, electric signals can be efficiently transmitted.

In the embodiment described above, all of the plurality of first contacts 22 of the first contact row 21 have the separation portions 22F, and all of the plurality of second contacts 32 of the second contact row 31 have the separation portions 32F; however, the present invention is not limited thereto.

Since the separation portions 22F and 32F are provided to suppress the occurrence of crosstalk when electric signals are transmitted, as shown in FIG. 5, the connector may be configured such that, of the plurality of first contacts 22 of the first contact row 21, only the first pair SP1 of contacts S6 and S7 and the two second pairs SP2 of contacts S2 and S3, and S10 and S11 for electric signal transmission have the separation portions 22F, while of the plurality of second contacts 32 of the second contact row 31, only the first pair TP1 of contacts T6 and T7 and the two second pairs TP2 of contacts T2 and T3, and T10 and T11 for electric signal transmission have the separation portions 32F, and the remaining contacts of the first contact row 21 and the second contact row 31 have no separation portion. Even with the configuration as above, it is possible to sufficiently suppress the occurrence of crosstalk via the mid-plate 15 and transmit electric signals with excellent characteristics.

The number of the contacts of the first contact row 21 and the second contact row 31 is not limited, and it suffices if each of the first contact row 21 and the second contact row 31 includes a plurality of pairs of contacts for electric signal transmission.

What is claimed is:

1. A connector having a predetermined effective connection length, the connector comprising:

a plurality of contacts having conductivity, the plurality of contacts extending in a fitting direction for fitting with a counter connector and being arranged in an arrangement direction perpendicular to the fitting direction;

a mid-plate of flat plate shape and having conductivity, the mid-plate extending in the fitting direction and the arrangement direction and being disposed to face the plurality of contacts; and a housing having insulating properties, the housing holding the plurality of contacts and the mid-plate, wherein the plurality of contacts include a first contact row and a second contact row that are separately arranged to face both surfaces of the mid-plate, wherein each of the first contact row and the second contact row includes a plurality of pairs of contacts, wherein each of the plurality of contacts has a contact portion that is disposed at a front end portion in the fitting direction, has a length corresponding to the effective connection length along the fitting direction, is exposed from the housing and makes contact with a contact of the counter connector, an exposed portion that is disposed adjacent to a rear end of the contact portion in the fitting direction and is exposed from the housing, a connecting portion that is disposed at a rear end portion in the fitting direction and is connected to a connection target, and a holding portion that is disposed between the exposed portion and the connecting portion and is at least partially embedded in the housing, wherein the contact portion of each of the plurality of contacts is disposed away from the mid-plate by a predetermined distance in a direction perpendicular to the mid-plate, wherein each of at least the plurality of pairs of contacts of the plurality of contacts has a separation portion that are separated from the mid-plate in the direction perpendicular to the mid-plate by a separation distance longer than the predetermined distance, and wherein the separation portion includes the exposed portion and a part of the holding portion adjacent to a rear end of the exposed portion in the fitting direction.

2. The connector according to claim 1, wherein all of the plurality of contacts including the plurality of pairs of contacts each have the separation portion.

3. The connector according to claim 2, wherein the separation portion of each of the plurality of contacts is separated from the mid-plate by the same separation distance.

4. The connector according to claim 1, wherein the housing has at least one housing step portion that covers the part of the holding portion adjacent to the rear end of the exposed portion of each of the plurality of contacts in the fitting direction, and wherein the at least one housing step portion of a part corresponding to the separation portion has a thickness equal to the separation distance.

5. The connector according to claim 4, wherein the housing has a pair of housing step portions in a corresponding manner to the first contact row and the second contact row.

6. The connector according to claim 5, further comprising a ground plate of flat plate shape and having conductivity, the ground plate being disposed on each of the pair of housing step portions.

7. The connector according to claim 1, wherein the plurality of contacts are integrally formed with the housing.

8. The connector according to claim 1, further comprising a conductive peripheral shell that covers an outer periphery of the housing to surround the contact portion and the exposed portion of each of the plurality of contacts and has a counter connector accommodating portion that opens frontward in the fitting direction.

* * * * *